US008424247B2

(12) United States Patent
Bourget

(10) Patent No.: US 8,424,247 B2
(45) Date of Patent: Apr. 23, 2013

(54) OSCILLATING-MOUNT SPLIT-HINGE DEVICE DESIGNED TO BE FITTED ON A VERY HEAVY DOOR, AND VERY HEAVY DOOR EQUIPPED WITH SUCH A DEVICE

(75) Inventor: Christian Bourget, Mezieres-en-Drouais (FR)

(73) Assignee: Baumert, Schaeffersheim (FR)

( * ) Notice: Subject to any disclaimer, the term of this patent is extended or adjusted under 35 U.S.C. 154(b) by 203 days.

(21) Appl. No.: 12/945,208

(22) Filed: Nov. 12, 2010

(65) Prior Publication Data

US 2011/0107677 A1 May 12, 2011

(30) Foreign Application Priority Data

Nov. 12, 2009 (FR) ..... 09 57975

(51) Int. Cl.
*E05F 15/10* (2006.01)
*E05F 15/02* (2006.01)
*E05D 11/04* (2006.01)

(52) U.S. Cl.
USPC ..... 49/334; 16/275

(58) Field of Classification Search ..... 49/237, 49/333, 334, 335, 336, 337, 338, 399; 16/275
See application file for complete search history.

(56) References Cited

U.S. PATENT DOCUMENTS

| | | | | | |
|---|---|---|---|---|---|
| 1,738,015 | A | * | 12/1929 | Parsons | 16/274 |
| 3,086,257 | A | * | 4/1963 | Haguet | 49/395 |
| 3,626,547 | A | * | 12/1971 | Werner | 16/314 |
| 3,832,755 | A | * | 9/1974 | Maertin et al. | 16/309 |
| 4,097,959 | A | * | 7/1978 | Johnson | 16/276 |
| 4,359,804 | A | * | 11/1982 | McNinch | 16/276 |
| 4,501,090 | A | * | 2/1985 | Yoshida et al. | 49/264 |
| 4,599,824 | A | * | 7/1986 | Mitsuhashi et al. | 49/141 |
| 4,829,633 | A | * | 5/1989 | Kassner | 16/322 |
| 4,864,689 | A | * | 9/1989 | Brockhaus | 16/262 |
| 5,930,868 | A | * | 8/1999 | Butler | 16/276 |
| 6,751,909 | B2 | * | 6/2004 | Ranaudo | 49/506 |
| 2008/0040886 | A1 | * | 2/2008 | Arnold et al. | 16/275 |
| 2009/0241289 | A1 | * | 10/2009 | Choi et al. | 16/275 |
| 2011/0094160 | A1 | * | 4/2011 | Houser | 49/31 |

FOREIGN PATENT DOCUMENTS

| | | | |
|---|---|---|---|
| DE | 9319914 | U1 | 3/1994 |
| FR | 829875 | A | 7/1938 |
| GB | 265388 | A | 2/1927 |

OTHER PUBLICATIONS

French Search Report, dated Jun. 23, 2010, from corresponding French application.

* cited by examiner

*Primary Examiner* — Katherine Mitchell
*Assistant Examiner* — Scott Denion
(74) *Attorney, Agent, or Firm* — Young & Thompson

(57) ABSTRACT

An oscillating-mount split-hinge device is provided that is designed to be fitted on a heavy door having at least one panel mounted to pivot on a frame. The split-hinge device includes at least one lower split-hinge configured to support at least the bulk of the load of the panel of the door, and at least one upper split-hinge configured to form an anti-tilting holding point and axial guide of the panel. Each of the lower split-hinge and the upper split-hinge includes a stationary split-hinge part integrated with the frame, and a movable split-hinge part integrated with the flap. Each of the lower split-hinge and the upper split-hinge also includes a pivoting shaft integrated with one of the frame and the panel, the pivoting shaft being configured to enable rotatably guiding the movable split-hinge part relative to the stationary split-hinge part around said pivoting shaft.

16 Claims, 8 Drawing Sheets

OSCILLATING-MOUNT SPLIT-HINGE DEVICE DESIGNED TO BE FITTED ON A VERY HEAVY DOOR, AND VERY HEAVY DOOR EQUIPPED WITH SUCH A DEVICE

CROSS-REFERENCE TO RELATED APPLICATION

This application claims priority to French Patent Application No. 0957975, filed Nov. 12, 2009, which is incorporated herein by reference in its entirety.

BACKGROUND OF THE INVENTION

1. Field of the Invention

This invention relates to the field of very heavy doors allowing in particular access to a closed space in a hostile environment and more particularly a closed space in a nuclear power plant, and it has as its object an oscillating-mount split-hinge device that is designed to be fitted on such very heavy doors. It also has as its object such a very heavy door that is equipped with said split-hinge device.

2. Description of the Related Art

It is known that a conventional door split-hinge that comprises a flap that pivots around a vertical axis consists of, on the one hand, two split-hinge parts—one of which, stationary, is mounted on the frame, and the other, movable, is mounted on said pivoting flap—and, on the other hand, a pivoting shaft—generally integral with the frame or, if necessary, the flap, which makes it possible to guide the unit in rotation by sliding, around said pivoting shaft, one of said split-hinge parts relative to the other.

The existing split-hinges are fitted on all types of doors of different weights, but those that are fitted on very heavy doors, weighing several tons, are to support axially significant loads, whose requirements and the actual standards in terms of safety are very high.

This is particularly the case of very heavy doors that are installed, using cranes, in hostile environments such as nuclear power plants and in particular in the building of said power plants that contains the nuclear reactor.

Split-hinge systems that are fitted on such very heavy doors that generally comprise a lower split-hinge that is designed to support at least the bulk of the load of the flap of the door and an upper split-hinge that is designed primarily to form an anti-tilting holding point and axial guide of the flap of said door are already known.

In a split-hinge system of this type, the lower split-hinge and the upper split-hinge each comprise a respectively lower and an upper pivoting shaft, making it possible to guide in rotation the respectively lower and upper movable split-hinge part relative to the respectively lower and upper stationary split-hinge part around said pivoting shaft, and this is done by insertion of roller bearing means.

Furthermore, the pivoting of the flap of the door for its opening or closing is done by a mechanical crank system or by a power unit, whose motor is generally attached to the frame and drives a rotary shaft that is integral with the flap and in particular the movable split-hinge part of the lower split-hinge.

It has been noted, however, that when such a very heavy door is opened, bending frequently occurs at the frame, producing an offsetting movement of the two respectively upper and lower split-hinges, which generates considerable friction at one and/or the other of the axes of said split-hinges, which has the effect of causing jamming between the axis in question and the corresponding split-hinge, and an increased pivoting force during the closing or opening movements of the pivoting flap of said door.

However, if the opening or the closing of the flaps of such very heavy doors can nevertheless be performed, even in the offset state, owing to the use of high-power power units to counteract the friction generated by said state, this goes against current economic requirements in terms of reducing production costs of such doors and lowering the consumption of said power units, which can be accomplished only by the use of power units of limited power.

The document FR 829 875 has as its object a joint device for the panel of a door by means of a pivot upright that consists of a metal pipe that is engaged at its lower end on a pivot that forms a step bearing that is sealed in the ground and at its upper end on a pivot, whereby said ends are locked respectively by an upper head and a lower head, while a spherical ball is inserted between the bottom of the lower head and the upper surface of the lower pivot.

However, this type of device that comprises a metal pipe, forming a hinge, requiring a sealing of its lower end in the ground by means of a step bearing by means of in particular a spherical ball, does not allow a sufficiently effective operation of the joint for an application to a very heavy door, in particular a door that is used in a nuclear power unit. In addition, the very heavy doors that are used in the nuclear field should be able to resist or withstand an earthquake, which does not allow a joint device such as the one that is described in the above-mentioned document, fitted on such a door. Actually, in this type of device, during an earthquake that produces combined movements of the door in several directions, the ball leaves its housing, thereby affecting the behavior and the resistance of the door during these sudden movements.

BRIEF SUMMARY OF THE INVENTION

This invention has as its object to eliminate these drawbacks by proposing an oscillating-mount split-hinge device for a very heavy door that makes it possible to prevent, in the offset state, all parasitic friction of the shafts of the split-hinges during opening and closing movements of the flap of said door, whether the door is equipped with a power unit, in particular of limited power, or with a mechanical opening system, for example using a crank, while imparting to the door effective behavior and resistance, in particular in the case of an earthquake.

For this purpose, the oscillating-mount split-hinge device is designed to be fitted on a very heavy door that consists of at least one flap or panel that is mounted to pivot on a frame, comprising at least one lower split-hinge that is designed in particular to support at least the bulk of the load of the flap of said door and at least one upper split-hinge that is designed in particular to form an anti-tilting holding point and axial guide of said flap, whereby each lower or upper split-hinge, on the one hand, consists of a stationary split-hinge part that is respectively integral with the frame, and a movable split-hinge part that is respectively integral with the flap, and, on the other hand, comprising a pivoting shaft that is integral with said frame, or, if necessary, flap, making it possible to guide in rotation the movable split-hinge part relative to the stationary split-hinge part around said pivoting shaft, and this is done by insertion of roller bearing means, and it is characterized essentially in that:

The guiding in rotation of the movable split-hinge part relative to the stationary split-hinge part around the pivoting shaft of each lower split-hinge is done by insertion of an axial superposition of at least one ball roller bearing that is designed to support primarily radial loads and at least one ball stop designed to support primarily axial loads, whereby said roller bearing means are able to allow an angular lack of coaxiality (a) on the part of the stationary split-hinge part relative to the movable split-hinge part of each so-called lower split-hinge, and The guiding in rotation of the movable split-hinge part relative to the stationary split-hinge part around the pivoting shaft of each upper split-hinge is done by insertion of a superposition of at least one ball roller bearing that is designed to support primarily the radial loads and is able to allow an angular lack of coaxiality of the stationary split-hinge part relative to the movable split-hinge part of each so-called upper split-hinge.

This invention also has as its object a very heavy door that consists of at least one flap that is mounted to pivot on a frame and that makes possible more particularly the access to a closed space of a hostile environment such as a nuclear power plant and that is characterized in that it comprises a split-hinge device according to this invention.

BRIEF DESCRIPTION OF THE DRAWINGS

The invention will be better understood using the description below, which relates to a preferred embodiment, provided by way of nonlimiting example and explained with reference to the accompanying diagrammatic drawings, in which.

DETAILED DESCRIPTION OF THE PREFERRED EMBODIMENTS

Figure 1:
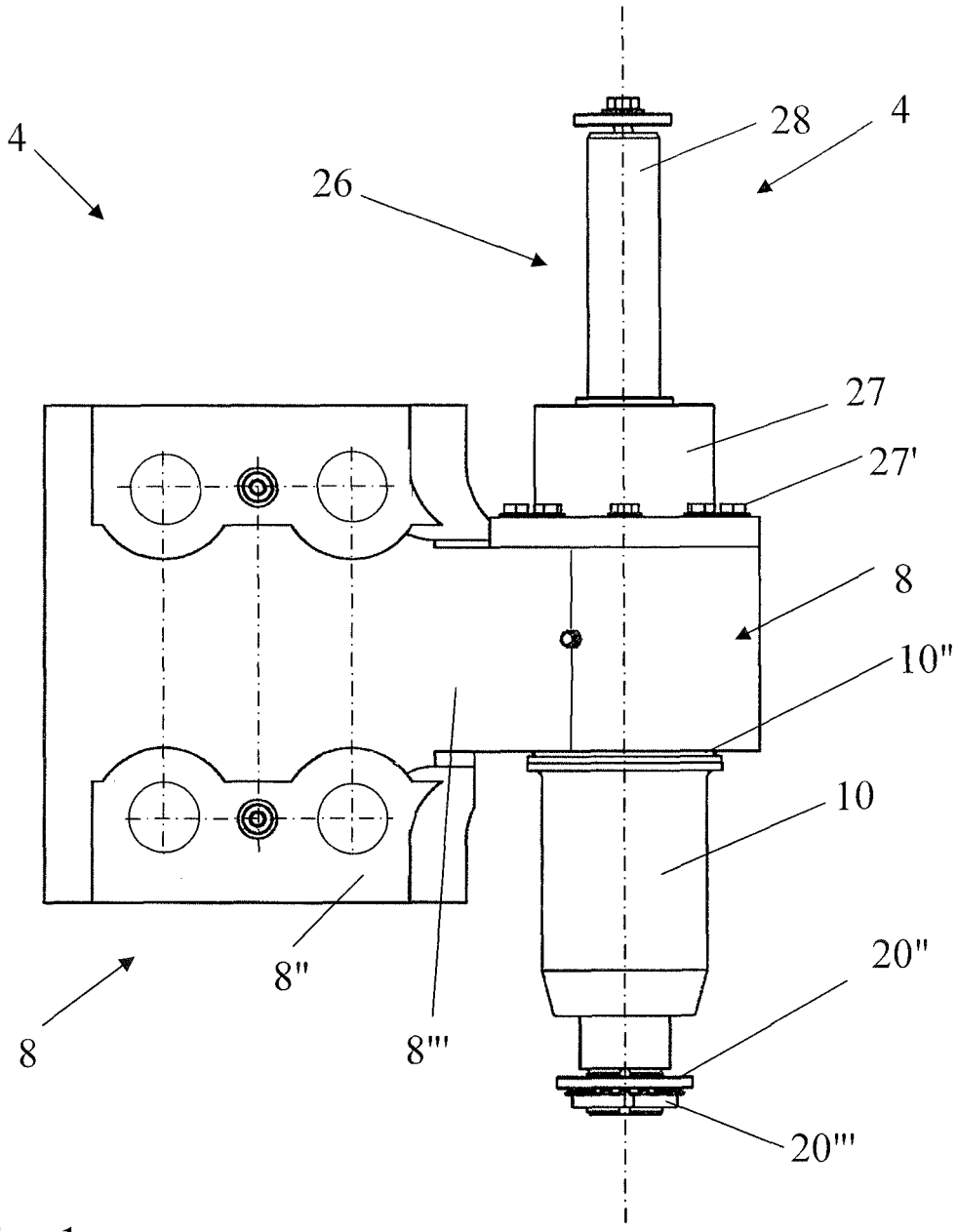
FIG. 1 shows a profile view of a lower split-hinge of the split-hinge device according to this invention in a preferred embodiment.

The figures show an oscillating-mount split-hinge device that is designed to be fitted on a very heavy door 1 that consists of at least one flap or panel 2 that is mounted to pivot on a frame 3 and that makes possible more particularly the access to a closed space of a hostile environment such as a nuclear power plant, whereby said device comprises at least one lower split-hinge 4 that is designed in particular to support at least the bulk of the load of the flap 2 of said door 1 and at least one upper split-hinge 5 that is designed in particular to form an anti-tilting holding point and axial guide of said flap 2, whereby each so-called lower split-hinge 4, or upper split-hinge 5, on the one hand, consists of a stationary split-hinge part 6, or 7, that is integral with the frame 3 and a movable split-hinge part 8, or 9, that is integral with the flap 2, and, on the other hand, comprising a pivoting shaft 10, or 11, that is integral with said frame 3, or, if necessary, the flap 2, making it possible to guide in rotation the movable split-hinge part 8, or 9, relative to the stationary split-hinge part 6, or 7, around said pivoting shaft 10, or 11, and this is done by insertion of roller bearing means 12, 13, 14.

According to this invention, the guiding in rotation of the movable split-hinge part 8 relative to the stationary split-hinge part 6 around the pivoting shaft 10 of each lower split-hinge 4 is done by insertion of an axial superposition of at least one ball roller bearing 12 that is designed to support primarily radial loads and at least one ball stop 14 that is designed to support primarily the axial loads, whereby said roller bearing means 12 and 14 are able to allow an angular lack of coaxiality (a) on the part of the stationary split-hinge 6 relative to the movable split-hinge part (8) of each so-called lower split-hinge 4. In addition, the guiding in rotation of the movable split-hinge part 9 relative to the stationary split-hinge part 7 around the pivoting shaft 11 of each upper split-hinge 5 is done by insertion of a superposition of at least one ball roller bearing 13 that is designed to support primarily the radial loads and is able to allow an angular lack of coaxiality on the part of the stationary split-hinge 7 relative to the movable split-hinge part 9 of each so-called upper split-hinge 5.

Figure 2:
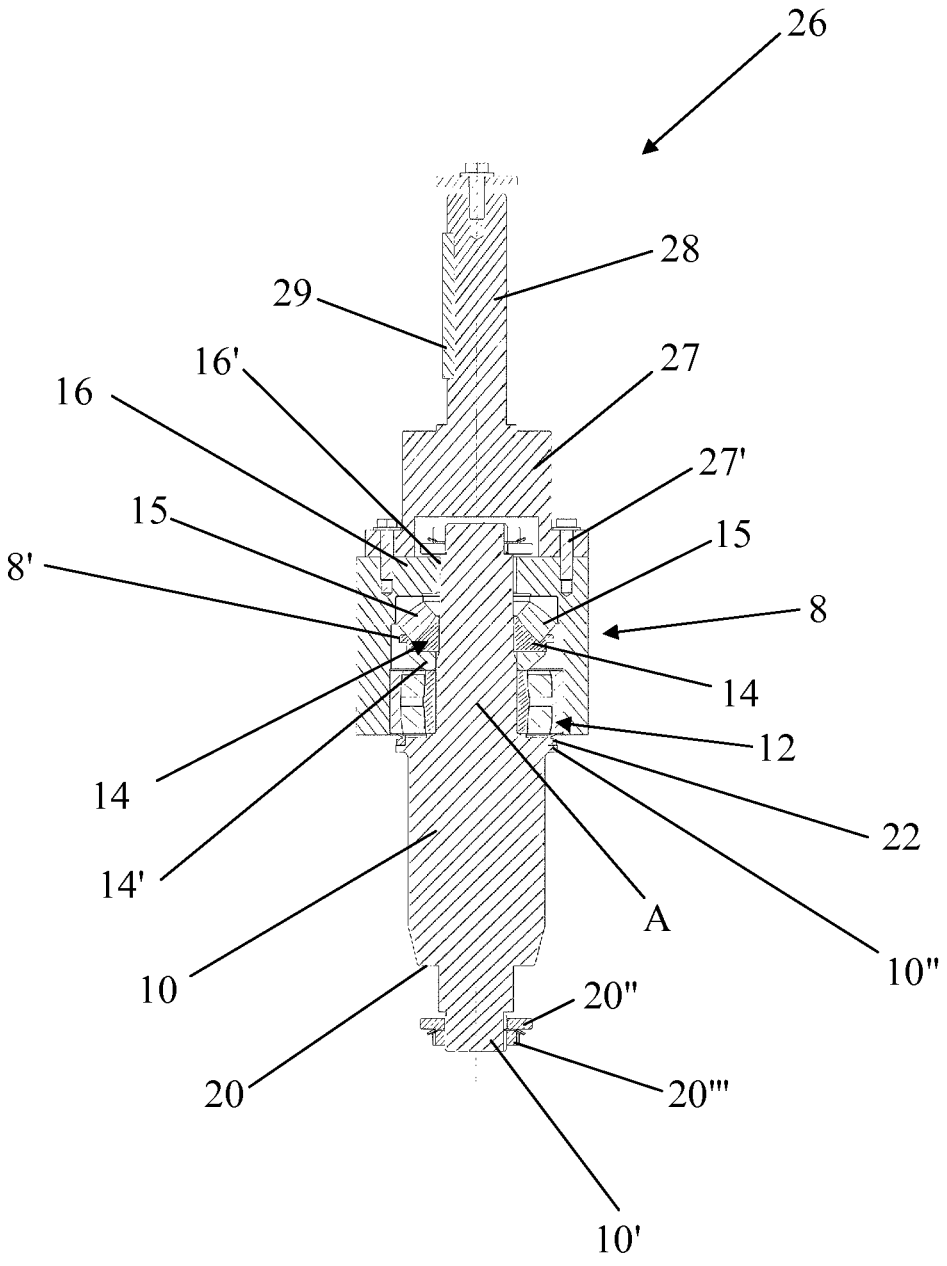
FIG. 2 shows a longitudinal cutaway view of the part of the split-hinge, represented in FIG. 1, through which the corresponding pivoting shaft passes.
Figure 3:
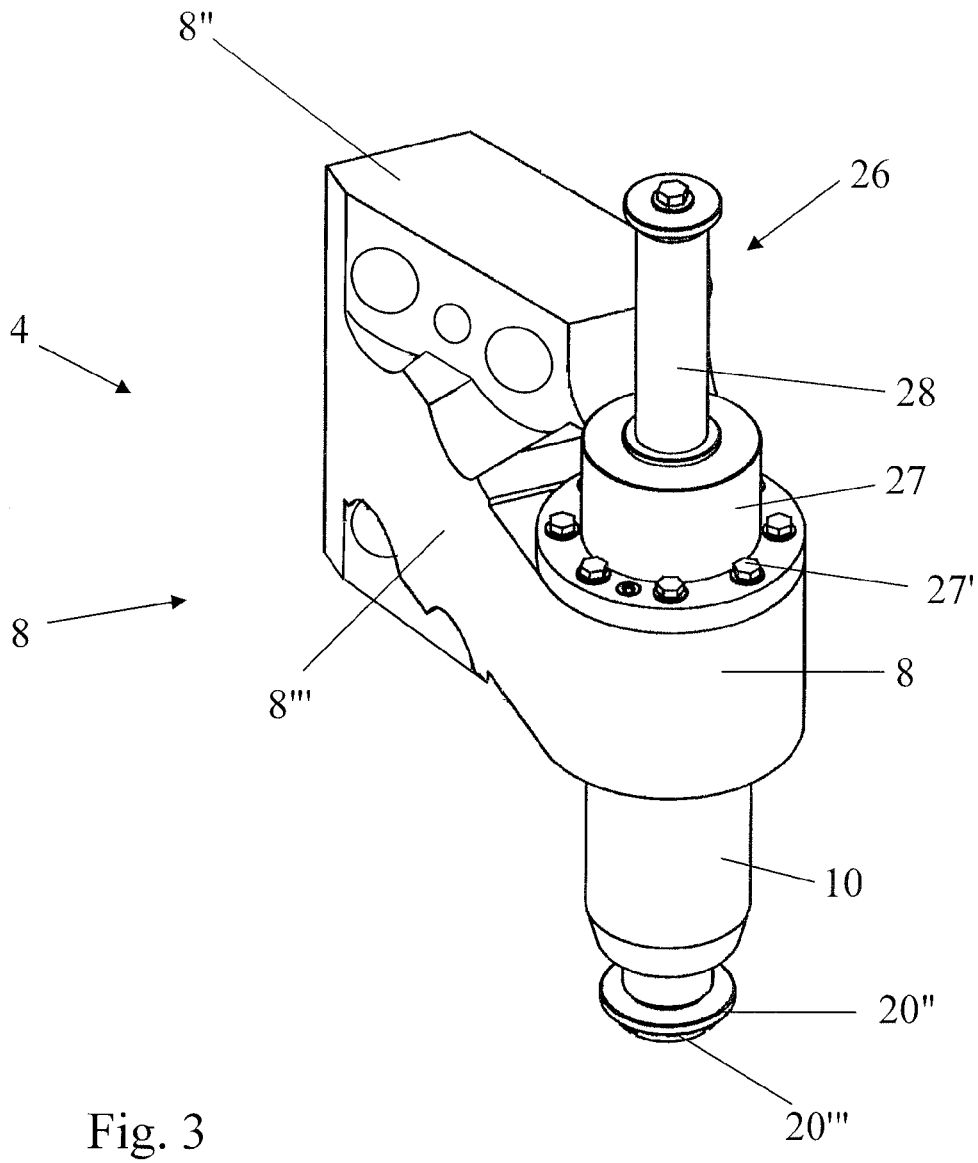
FIG. 3 shows a top ¾ perspective view of the lower split-hinge that is represented in FIG. 1.
Figure 4:
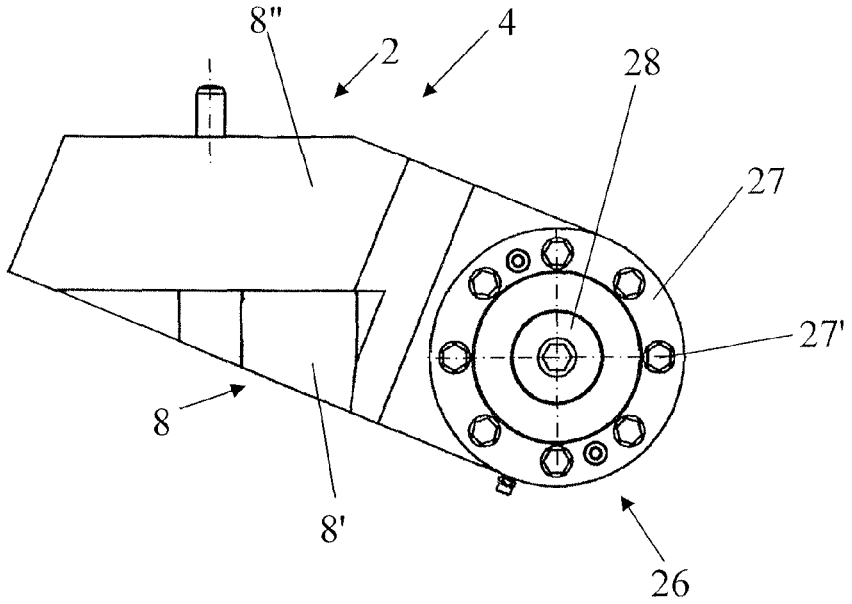
FIG. 4 represents a top view of the lower split-hinge that is represented in FIG. 1.
Figure 5:
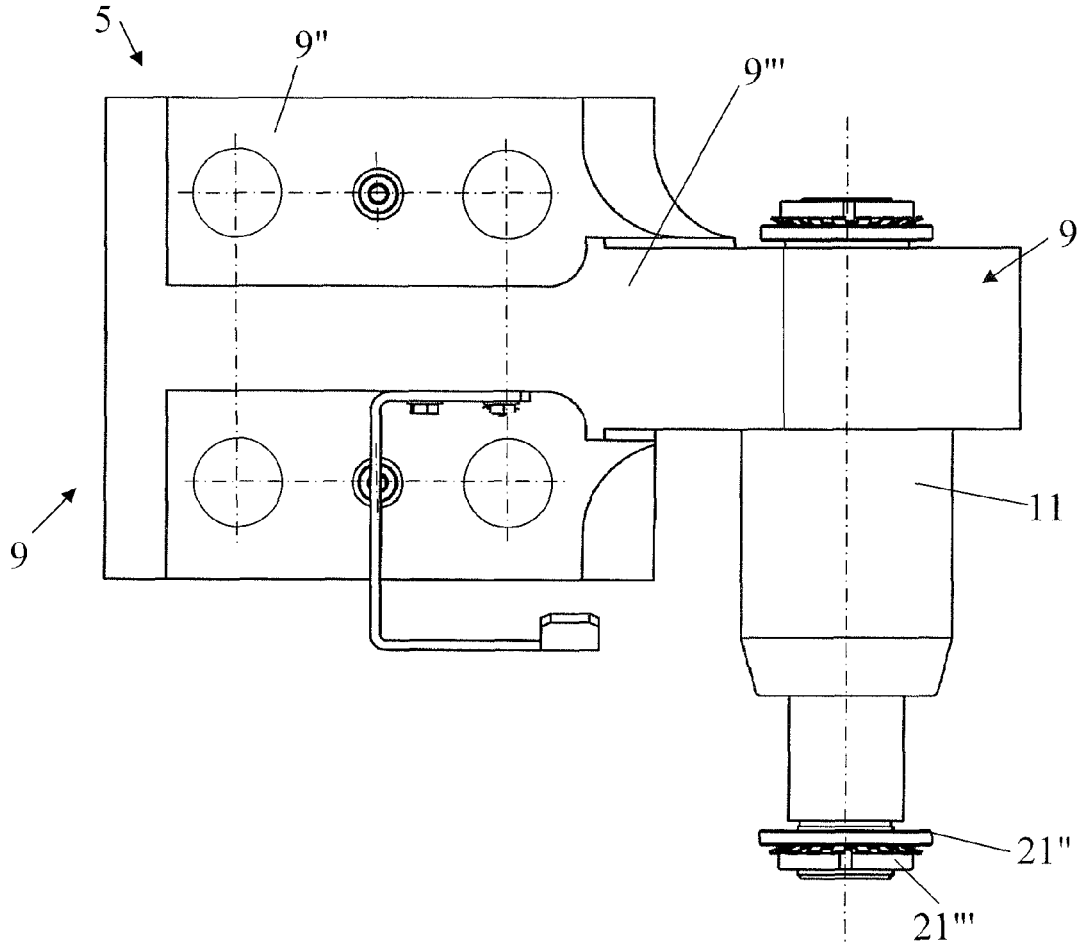
FIG. 5 represents a profile view of an upper split-hinge of the split-hinge device according to this invention in a preferred embodiment.

If reference is now made to FIG. 2, it is possible to see that each lower split-hinge 4 can preferably comprise a ball roller bearing 12 and a ball stop 14, whose application point A of the resultant of the contact actions of the roller bearing elements 15 of said ball stop 14 is eccentric relative to its median plane. The ball stop 14 is advantageously combined, in a mated way, with said ball roller bearing 12 in such a way that said application point A corresponds essentially to the pivoting center of said ball roller bearing 12. In addition, the axial spacing between said ball roller bearing 12 and said ball stop 14 can preferably be adjusted by means of an adjustment brace 14' through which the lower pivoting shaft 10 passes axially and is inserted between said stop 14 and said ball roller bearing 12.

Figure 11:
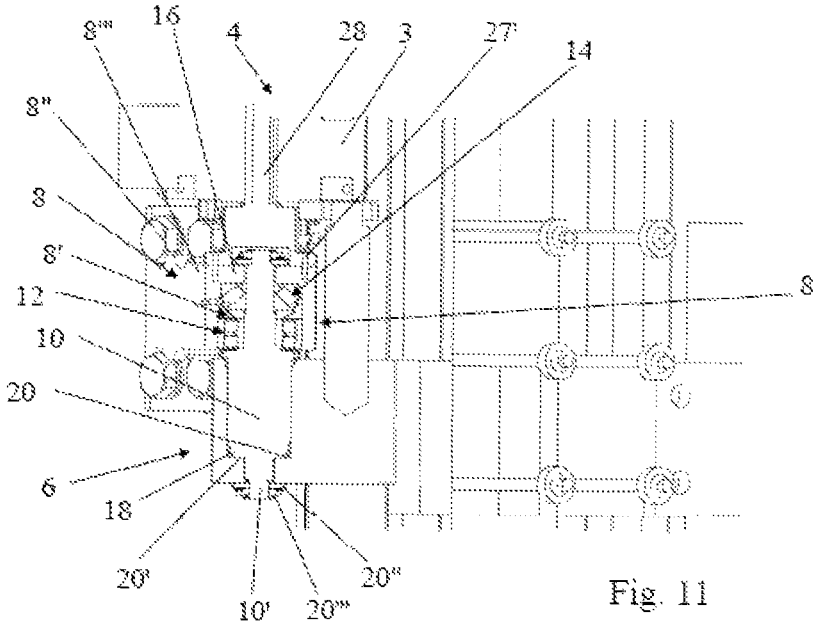
FIG. 11 is a perspective view along a longitudinal cutaway of the lower split-hinge that is represented in FIG. 1 and mounted on a very heavy door according to this invention.
Figure 12:
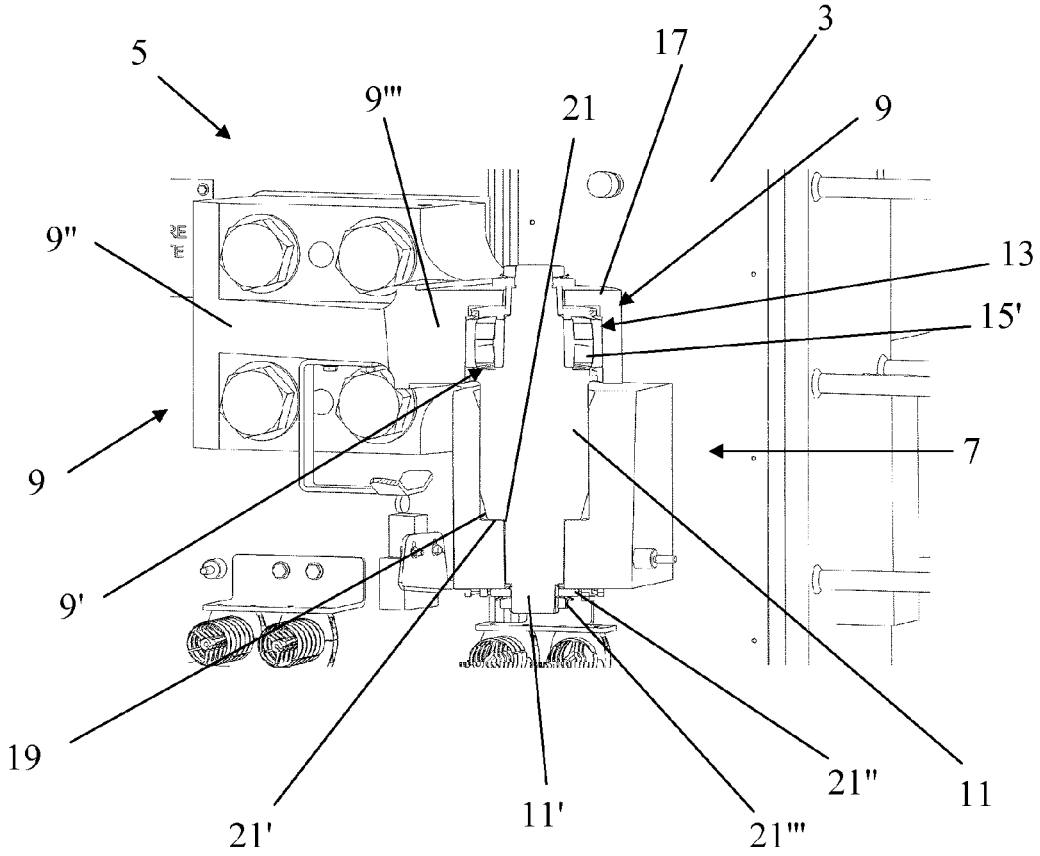
FIG. 12 is a perspective view along a longitudinal cutaway of the upper split-hinge represented in FIG. 5 and mounted on a very heavy door according to this invention.

Preferably, the movable split-hinge part 8, or 9, of each lower split-hinge 4 or upper split-hinge 5, can be attached to the flap 2 and can comprise a hub 8', or 9', designed to accommodate the corresponding pivoting shaft 10, or 11, while the stationary split-hinge part 6, or 7, of each lower split-hinge 4, or upper split-hinge 5, preferably has a hinge shape that carries said pivoting shaft 10, or 11 (FIG. 11 and FIG. 12).

Figure 9:
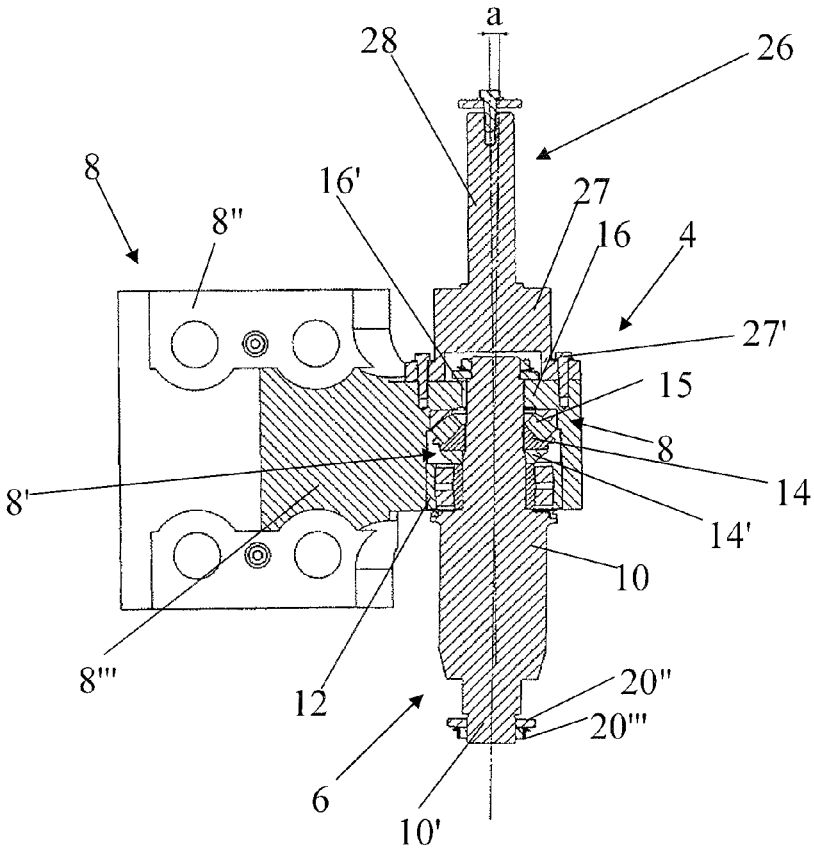
FIG. 9 represents a longitudinal cutaway view of the lower split-hinge that is represented in FIG. 1 in the offset state.

In this case, the pivoting shaft 10 of each lower split-hinge 4 can be mounted to rotate freely in the corresponding hub 8' by successively passing through, from the base of said hub 8', the ball roller bearing 12, the adjustment brace 14', the ball stop 14, and a plain bearing 16 (FIG. 2 and FIG. 9). The latter forms a pivot connection while preserving play 16' between said lower pivoting shaft 10 and the inside sliding surface of said plain bearing 16, making possible the angular offset (a)

of said lower pivoting shaft 10 within the angular limits that are imposed by said ball roller bearing 12 and said ball stop 14 that is combined with the latter, and more particularly within angular limits encompassed between approximately 1 and 2 degrees, preferably between 1.2 and 1.5 degrees, and more preferably between 1.25 and 1.30 degrees, as can be seen in FIG. 9.

Figure 6:
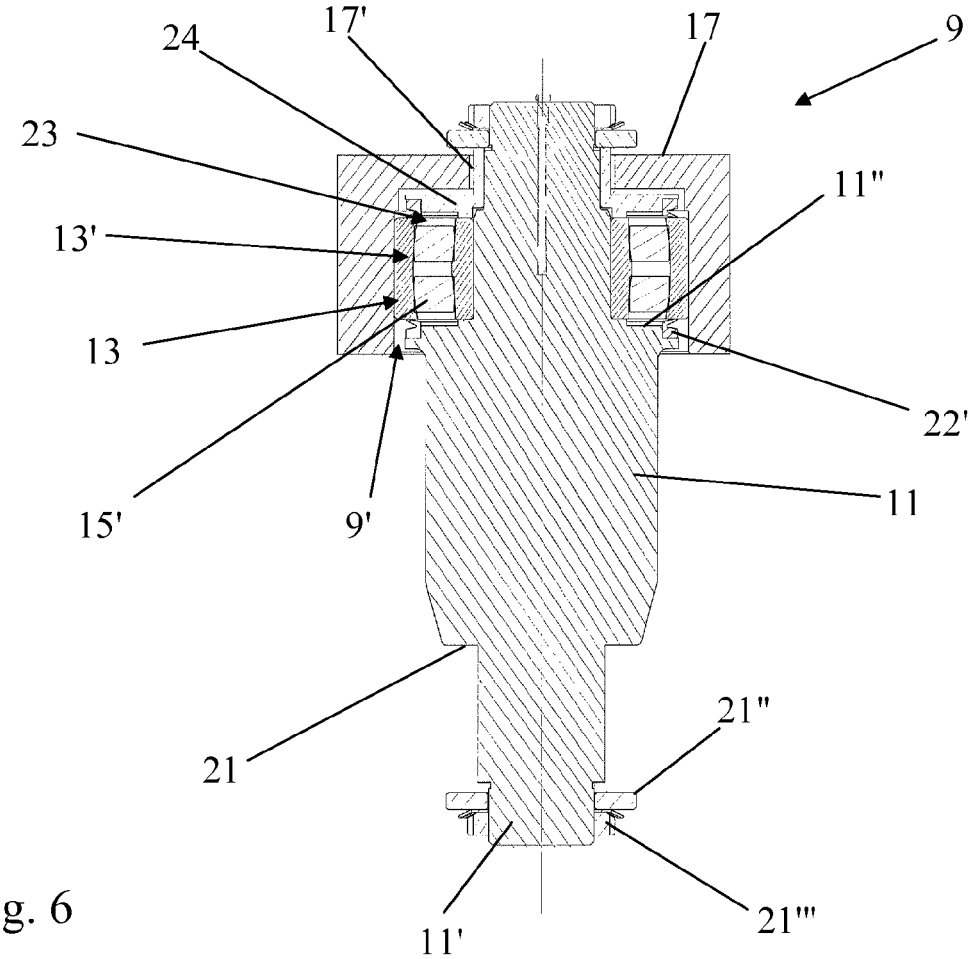
FIG. 6 shows a longitudinal cutaway view of the part of the split-hinge, represented in FIG. 5, through which the corresponding pivoting shaft passes.
Figure 7:
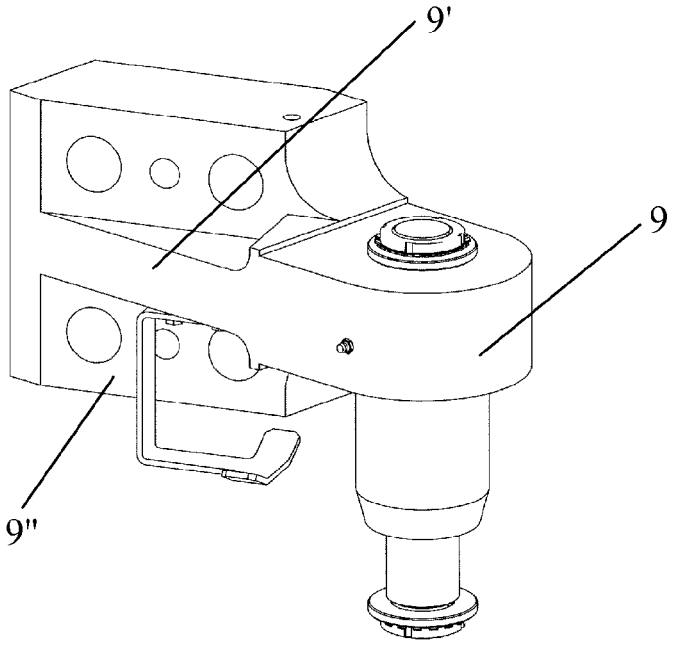
FIG. 7 shows a ¾ perspective view of the upper split-hinge that is represented in FIG. 5.
Figure 8:
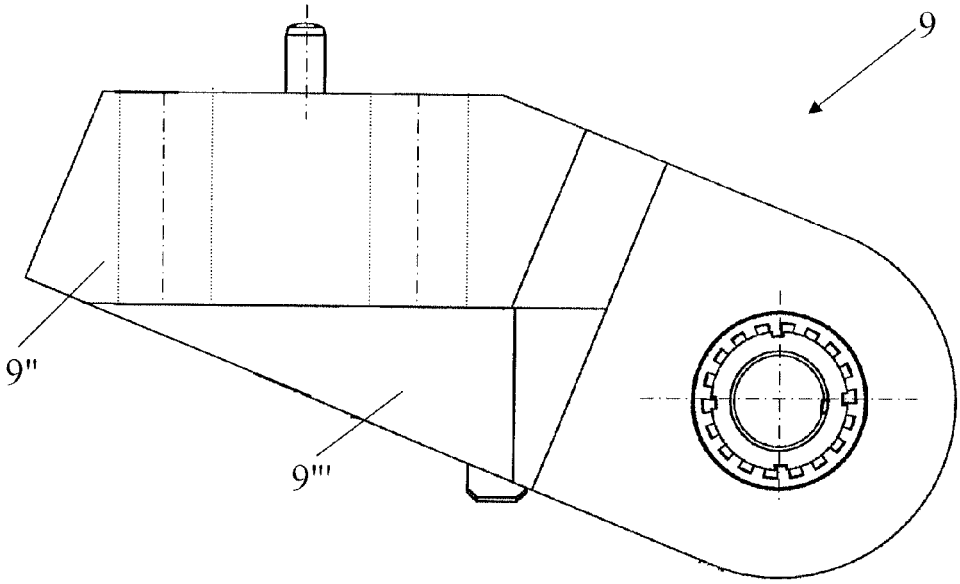
FIG. 8 represents a top view of the lower split-hinge that is represented in FIG. 1.

Always in this case, as can be seen in FIG. 6, each upper split-hinge 5 can preferably comprise a ball roller bearing 13, and the pivoting shaft 11 of each so-called upper split-hinge 5 can be mounted to rotate freely in the corresponding hub 9' by successively passing through, from the base of said hub 9', said ball roller bearing 13 and a plain bearing 17 forming a pivot connection that preserves play 17' that allows the off-setting, not shown, of said pivoting shaft 11 within the angular limits that are imposed by said ball roller bearing 13, and more particularly within angular limits of between approximately 1 and 2 degrees, preferably between 1.2 and 1.5 degrees, and more preferably between 1.25 and 1.30 degrees.

Figure 10:
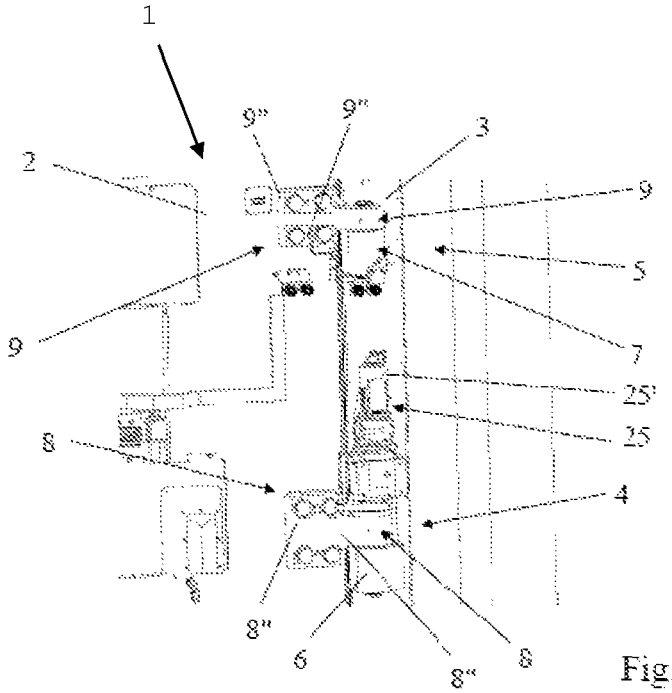
FIG. 10 is a perspective view of the mounting of two respectively lower and upper split-hinges, represented respectively in FIG. 1 and in FIG. 5, mounted on a very heavy door according to this invention.

The stationary split-hinge part 6, or 7, of each lower split-hinge 4, or upper split-hinge 5, can consist of a hollow piece in the form of an eyelet that is attached to the frame 3 and that comprises a receiving cavity 18, or 19, of an axis that is essentially combined with the axis of rotation of the flap 2 (FIG. 10).

Thus, as can be seen in FIG. 11 and in FIG. 12, the pivoting shaft 10, or 11, of each lower split-hinge 4, or upper split-hinge 5, can be engaged, for example, on the one hand, by its low part, in said corresponding receiving cavity 18, or 19, in which it is held and centered axially essentially on said axis of rotation in an essentially vertical position, with axial and anti-rotational locking, by means of a casing connection between said pivoting shaft 10, or 11, and the corresponding receiving cavity 18, or 19, and, on the other hand, by its top part, in the corresponding hub 8', or 9', of the movable split-hinge part 8, or 9.

This invention can ensure that the pivoting shaft 10, or 11, or each lower split-hinge 4 or upper split-hinge 5, ends at one of its ends that extends downward beyond the corresponding receiving cavity 18, or 19, by an end fitting 10', or 11', preferably threaded on its outside surface, and that the casing connection can consist of, on the one hand, a first shoulder 20, or 21, made in said corresponding pivoting shaft 10, or 11, that mates with a second shoulder 20', or 21', made in the inside wall of the receiving cavity 18, or 19, so as to prevent the axial movement of the lower pivoting shaft 10, or upper pivoting shaft 11, downward, and, on the other hand, a stop washer 20", or 21", placed around said end fitting and being held, with locking, in a stop position by means of a nut 20'", or 21'", screwed onto the threaded part of said end fitting 10', or 11', so as to prevent the axial movement of said pivoting shaft 10, or 11, upward and starting from its disengagement from the corresponding hub 8', or 9'.

If reference is now made to FIG. 2 and to FIG. 6, it is possible to see that the ball roller bearing 13 of each upper split-hinge 5, or the ball roller bearing 12 and ball stop 14 system of each lower split-hinge 4, is preferably locked axially in the hub 8', or 9', of the corresponding movable split-hinge part 8, or 9, between, on the one hand, a shoulder 10", or 11", made in the outside surface of the pivoting shaft 10, or 11, by means of an annular sealing joint 22, or 22', and, on the other hand, the corresponding plain bearing 16, or 17.

In addition, each upper split-hinge 5 can comprise an intermediate piece 24, for example, in the form of a sleeve through which the pivoting shaft 11, corresponding to the corresponding level of the plain bearing 17, passes, while the base of said intermediate piece 24 can be enlarged by extending radially to cover tightly, for example by means of an annular joint 23, the cage 13' of the ball roller bearing 13. In addition, said intermediate piece 24 can advantageously be installed in particular after having filled said cage with lubricating grease of the roller bearing elements 15' of said ball roller bearing 13 (FIG. 6).

Preferably, the ball roller bearing(s) 12, 13 are advantageously ball roller bearings on rollers, preferably conical rollers, on balls or on needles, and preferably ball roller bearings on rollers with two rows of preferably conical rollers, able to support heavy loads, and the ball stop(s) 14 is/are advantageously ball stops on rollers that can support heavy axial loads but also relatively large radial loads.

Preferably, a lower split-hinge 4 can comprise a ball roller bearing 12 on rollers with two rows of conical rollers and one ball stop on rollers, while an upper split-hinge 5 can comprise a ball roller bearing 13 on rollers with two rows of conical rollers, as can be seen in particular in FIG. 2 and in FIG. 6.

This invention can ensure that the pivoting of the flap 2 of the very heavy door for its opening or closing is done by means of a power unit 25, preferably with limited power, comprising a motor 25', such as, for example, a geared motor, designed to drive, for example by means of a drive key 29, a drive shaft 26 that is integral with said flap 2 and preferably the movable split-hinge part 8 of each lower split-hinge 4, as can be seen in FIG. 2 and in FIG. 10.

It is also possible to see in the figures that the movable split-hinge part 8, or 9, of each lower split-hinge 4, or upper split-hinge 5, can consist of a support plate 8", or 9", designed to be attached in a known manner, for example by screwing, on the flap 2 and extending via an arm 8'", or 9'", carrying at its free end the part that forms the hub 8', or 9', and that said arm 8'", or 9'", can extend advantageously by moving away from the plane of the flap 2 so as to create a space or sufficient disengagement from said flap 2 to house and implement the power unit 25, preferably at each lower split-hinge 4. The drive shaft 26 of the flap 2 that is driven in rotation by the motor 25' can advantageously constitute an axial extension upward of the hub 8' of the corresponding movable split-hinge part 8 of each so-called lower split-hinge 4.

This invention can ensure, as can be seen in particular in FIG. 1, FIG. 2, FIG. 3 and FIG. 10, that the drive shaft 26 can preferably consist of a hood 27 with an overall cylindrical shape that can cover, with its enlarged base, the upper surface of the corresponding hub 8' of the movable split-hinge part 8 of the lower split-hinge 4, on which upper surface said hood 27 is preferably attached by screwing of the screw 27' and extends axially on its upper part by a drive shaft 28 that comprises—on its outside surface—at least one connection key 29, preferably extending longitudinally on said outside surface, making it possible to link in rotation said drive shaft 28 with the drive means, not shown, of said motor 25, which can be, for example, a drive hub in which at least one key groove that can functionally accommodate the corresponding connection key 29 can be made.

The figures also show a very heavy door 1 according to this invention that consists of at least one flap 2 that is mounted to pivot on a frame 3 and that makes possible more particularly the access to a closed space of a hostile environment such as a nuclear power plant, whereby said door is equipped with a split-hinge device, according to this invention, preferably comprising a lower split-hinge 4 and an upper split-hinge 5.

Of course, the invention is not limited to the embodiment that is described and shown in the accompanying drawings. Modifications are possible, in particular from the standpoint of the composition of various elements or by substitution of equivalent techniques, without thereby exceeding the field of protection of the invention.

The invention claimed is:

1. An oscillating-mount split-hinge device configured to be fitted on a door that includes at least one panel that is mounted to pivot on a frame, the split-hinge device comprising:

at least one lower split-hinge configured to support at least the bulk of the load of the panel of said door; and at least one upper split-hinge configured to form an anti-tilting holding point and axial guide of the panel, wherein each of the lower split-hinge and the upper split-hinge comprises one or more of a stationary split-hinge part integrated with the frame and a movable split-hinge part attached to and integrated with the panel, and a pivoting shaft configured to be integrated with one of the frame and the panel, the pivoting shaft being configured to enable rotatably guiding the movable split-hinge part relative to the stationary split-hinge part around said pivoting shaft, wherein insertion of an axial superposition of at least one ball roller bearing and at least one ball stop about the upper pivoting shaft allows for guiding rotation of the movable split-hinge part relative to the stationary split-hinge part around the pivoting shaft of the lower split-hinge the at least one ball roller bearing of the lower-split hinge being configured to support primarily radial loads, the at least one ball stop being configured to support primarily axial loads, the at least one ball roller bearing and the at least one ball stop of the lower split-hinge being configured to permit an angular lack of coaxiality of the stationary split-hinge part relative to the movable split-hinge part of the lower split-hinge, an application point of resulting contact actions of roller bearing elements of said ball stop being eccentric relative to the median plane of the ball stop, the ball stop being mated with the ball roller bearing such that said application point substantially corresponds to the pivoting center of the ball roller bearing, an axial spacing between the ball roller bearing and the ball stop being adjustable by an adjustment brace through which the lower pivoting shaft passes axially and is inserted between the ball stop and the ball roller bearing, wherein insertion of a superposition of at least one ball roller bearing about the upper pivoting shaft allows for guiding rotation of the movable split-hinge part relative to the stationary split-hinge part around the pivoting shaft of each upper split-hinge the at least one ball roller bearing of the upper split-hinge being configured to support primarily the radial loads, the at least one ball roller bearing of the upper split-hinge being configured to permit an angular lack of coaxiality of the stationary split-hinge part relative to the movable split-hinge part of the upper split-hinge, and wherein each movable split-hinge part comprises a hub configured to accommodate the corresponding pivoting shaft, the stationary split-hinge part of each lower split-hinge and upper split-hinge having a hinge shape that carries the pivoting shaft, the pivoting shaft of the lower split-hinge being mounted to rotate freely in the corresponding lower hub by successively passing through, from a base of the lower hub, the ball roller bearing, the adjustment brace, the ball stop, and a plain bearing forming a pivot connection that preserves play between the corresponding pivoting shaft and an inside sliding surface of said plain bearing to facilitate an angular offset of the pivoting shaft within the angular limits imposed by the ball roller bearing and said ball stop associated with the ball roller bearing, and the pivoting shaft of each upper split-hinge being mounted to rotate freely in the corresponding hub by successively passing from a base of the upper hub, through the ball roller bearing and a plain bearing forming a pivot connection that preserves play to offset the upper pivoting shaft within angular limits imposed by the ball roller bearing.

2. The device according to claim 1, wherein the stationary split-hinge part of each lower split-hinge and upper split-hinge comprises a hollow piece in the form of an eyelet attached to the frame and comprising a corresponding receiving cavity having an axis that is substantially combined with the axis of rotation of the panel, and wherein the pivoting shaft of each lower split-hinge and upper split-hinge is engaged by a low part of the pivoting shaft in said corresponding receiving cavity, the pivoting shaft being held and centered axially substantially on said axis of rotation in a substantially vertical position, with axial and anti-rotational locking, by a casing connection between said corresponding pivoting shaft and the corresponding receiving cavity, and is engage by a top part of the corresponding pivoting shaft in the corresponding hub of the movable split-hinge part of each lower split-hinge and upper split-hinge.

3. The device according to claim 2, wherein the corresponding pivoting shaft ends at a lower end, which extends downward beyond the receiving cavity, by a threaded end fitting, and wherein the each casing connection comprises a first shoulder formed in the corresponding pivoting shaft that mates with a second shoulder formed in the inside wall of the corresponding receiving cavity to prevent the axial movement of the pivoting shaft downward, and a stop washer placed around said end fitting and being held in a stop position by a locking means screwed onto a threaded part of said corresponding end fitting to prevent the axial movement of said corresponding pivoting shaft in an upward direction.

4. The device according to claim 1, wherein one or more of the ball roller bearing of the upper split-hinge, and the ball roller bearing and the ball stop system of the lower split-hinge, is locked axially in the corresponding hub of the corresponding movable split-hinge part between a shoulder formed in an outer surface of the pivoting shaft by means of an annular sealing joint, and the corresponding plain bearing.

5. The device according to claim 4, wherein the upper split-hinge further comprises an intermediate piece in the form of a sleeve through which the upper pivoting shaft, corresponding to the level of the corresponding plain bearing, passes, a base of the intermediate piece being enlarged by extending radially to tightly cover a cage of the upper ball roller bearing.

6. The device according to claim 1, wherein both ball roller bearings are ball roller bearings on one or more of rollers, balls or needless, and the ball stop is on rollers.

7. The device according to claim 1, wherein the pivoting of the panel of the door for the one or more of the opening and closing of the door is controlled by a power unit comprising a motor configured to drive a drive shaft integrated with one or more of the panel and the movable split-hinge part of each lower split-hinge.

8. The device according to claim 7, wherein the movable split-hinge part of each of the lower split-hinge and the upper split-hinge comprises a support plate configured to be attached to the panel and extending from an arm that carries the corresponding hub, the arm extending away from the plane of the panel to create a space or sufficient disengagement from the panel to house and implement the power unit, the drive shaft being an upward axial extension upward of the hub of the corresponding movable split-hinge part of each lower split-hinge.

9. The device according to claim 8, wherein said drive shaft comprises a hood having an overall cylindrical shape with an enlarged base that can cover, with the enlarged base, the upper surface of the corresponding hub of the movable split-hinge part of the lower split-hinge, on which the upper surface said hood is attached by screwing and extends axially on an upper part by a drive shaft that comprises, on an outside surface thereof, at least one connection key, to enable linking in rotation the drive shaft with the drive means of said motor.

10. A door, comprising:

a frame; and at least one panel mounted to pivot on the frame, the at least one panel permitting access to a closed space, the at least one panel having a split-hinge device according to claim 1 attached thereto.

11. The device according to claim 1, wherein the pivoting of the panel of the door for one or more of opening and closing of the door is controlled by a power unit, comprising a motor configured to drive a drive shaft that is integrated with the panel and the movable split-hinge part of each lower split-hinge.

12. The device according to claim 1, wherein the angular limits of the angular offset of each of the lower pivoting shaft and the upper pivoting shaft are between approximately 1 and 2 degrees.

13. The device according to claim 12, wherein the angular limits are between 1.2 and 1.3 degrees.

14. The device according to claim 5, wherein an annular joint is used to tightly cover the cage of the ball roller bearing.

15. The device according to claim 6, wherein the rollers are conical rollers.

16. The device according to claim 15, wherein the ball roller bearings are bearings on rollers with two rows of conical rollers.

* * * * *